US008092244B1

(12) United States Patent
Lan et al.

(10) Patent No.: US 8,092,244 B1
(45) Date of Patent: Jan. 10, 2012

(54) ELECTRICAL CONNECTOR

(75) Inventors: Rong-Qin Lan, Guang-Dong (CN); Li-Jun Xu, Guang-Dong (CN); Ming-Han Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/980,314

(22) Filed: Dec. 28, 2010

(51) Int. Cl.
*H01R 4/48* (2006.01)

(52) U.S. Cl. ..... 439/345

(58) Field of Classification Search ..... 439/345, 439/346

See application file for complete search history.

(56) References Cited

U.S. PATENT DOCUMENTS

| | | | | |
|---|---|---|---|---|
| 7,625,232 | B2 * | 12/2009 | Lin et al. | 439/495 |
| 2008/0160818 | A1 * | 7/2008 | Liu et al. | 439/345 |
| 2009/0047833 | A1 * | 2/2009 | Lin et al. | 439/630 |
| 2009/0075511 | A1 * | 3/2009 | Givens et al. | 439/345 |

* cited by examiner

*Primary Examiner* — James Harvey
(74) *Attorney, Agent, or Firm* — Cheng-Ju Chiang

(57) ABSTRACT

An electrical connector includes an insulating housing with a plurality of terminals disposed therein, a buckling part, and a locking element. The insulating housing has a receiving chamber penetrating through a rear thereof. The insulating housing defines two buckling grooves with rears thereof being narrower than fronts thereof, and two fixing grooves connecting with insides of the buckling grooves. The buckling part is inserted in the buckling groove, and has a base arm, a contact arm and a fixing arm having a greater width than that of the base arm to be buckled in the front of the buckling groove. The locking element is inserted in the fixing groove, and has a base board resisting against the fixing arm, a fastening portion and a hook grappling an inside of the fixing groove. The fastening portion is located between the inside of the fixing groove and the fixing arm.

9 Claims, 4 Drawing Sheets

ELECTRICAL CONNECTOR

BACKGROUND OF THE INVENTION

1. Field of the Invention

The present invention relates to an electrical connector, and more particularly to an electrical connector capable of being assembled tightly.

2. The Related Art

A traditional electrical connector generally includes an insulating housing, a plurality of terminals disposed in the insulating housing, and a plurality of buckling parts. The buckling parts are assembled to the insulating housing. When the electrical connector is engaged with a mated connector, the buckling parts are used for providing insertion, withdrawal and retention force. However, when the electrical connector is inserted or pulled out from the mated connector, the buckling parts are apt to fall off from the electrical connector because of no fastening elements assembled to the insulating housing to fasten the buckling parts in the insulating housing tightly.

SUMMARY OF THE INVENTION

An object of the present invention is to provide an electrical connector. The electrical connector includes an insulating housing, a plurality of terminals, a buckling part and a locking element. The insulating housing has a receiving chamber penetrating through a rear surface thereof. A top wall, a bottom wall, a pair of side walls and a front wall are formed around the receiving chamber. Two ends of the front wall define two buckling grooves each extending longitudinally to an inside of the corresponding side wall and communicating with the receiving chamber. A rear of the buckling groove is narrower than a front thereof. The two ends of the front wall further defines two fixing grooves each extending longitudinally to penetrate through the front wall and connected with the receiving chamber and an inside of the corresponding buckling groove. The terminals are disposed in the insulating housing. The buckling part is inserted rearward in the buckling groove. The buckling part has a base arm, a contact arm projecting inward into the receiving chamber, and a fixing arm extending forward from a front edge of the base arm and having a greater width than that of the base arm to be buckled in the front of the buckling groove. The locking element is inserted rearward in the fixing groove. The locking element has a base board, a fastening portion protruded rearward from a rear side of the base board, and a hook protruded inward to grapple a rear of an inside of the fixing groove for fastening the locking element in the fixing groove. Two opposite side surfaces of the fastening portion respectively abut against the inside of the fixing groove and the fixing arm. The rear side of the base board further resists against a front edge of the fixing arm to hold the buckling part in the insulating housing.

As described above, the fixing arms are buckled in the front of the buckling grooves to prevent the buckling parts sliding rearward to the receiving chamber, the front edge of the fixing arm further resists against the rear side of the locking element to prevent the buckling part falling off from the buckling groove, the fixing arms are located between the inside of the fixing groove and the fixing arm to avoid the buckling parts swaying, so that the buckling parts are fastened in the insulating housing of the electrical connector tightly.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
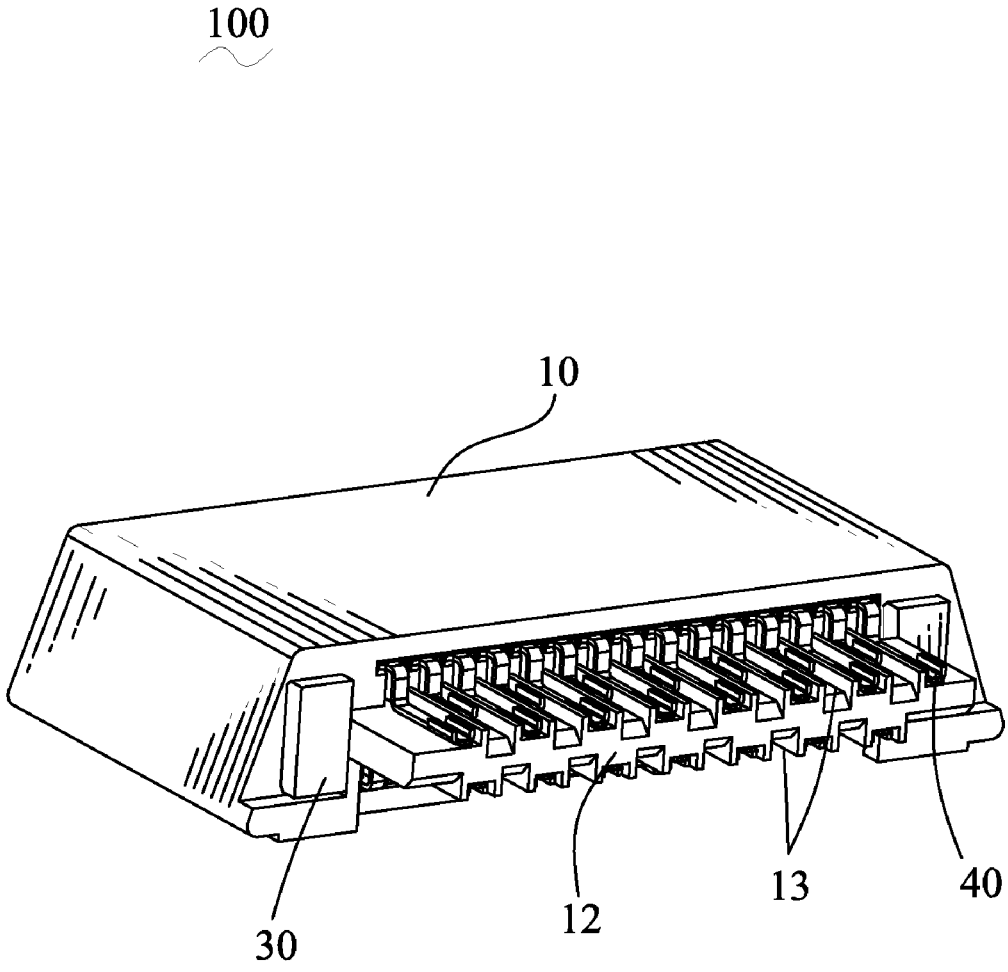
FIG. 1 is a perspective view of an electrical connector in accordance with the present invention.
Figure 2:
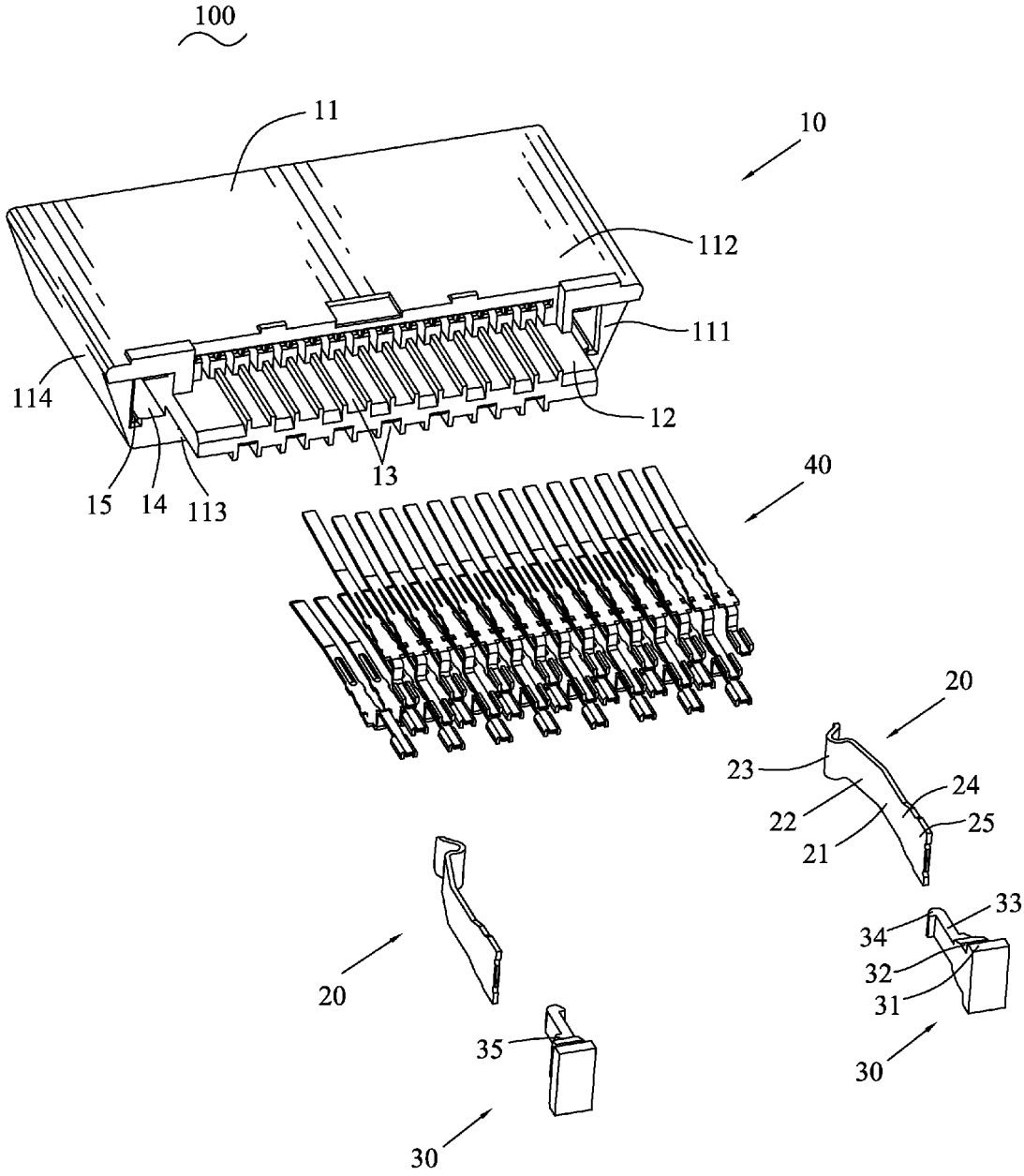
FIG. 2 is an exploded view of the electrical connector of FIG. 1.

Referring to FIG. 1 and FIG. 2, an electrical connector 100 according to the present invention includes an insulating housing 10, a plurality of terminals 40, two buckling parts 20 and two locking elements 30.

Figure 3:
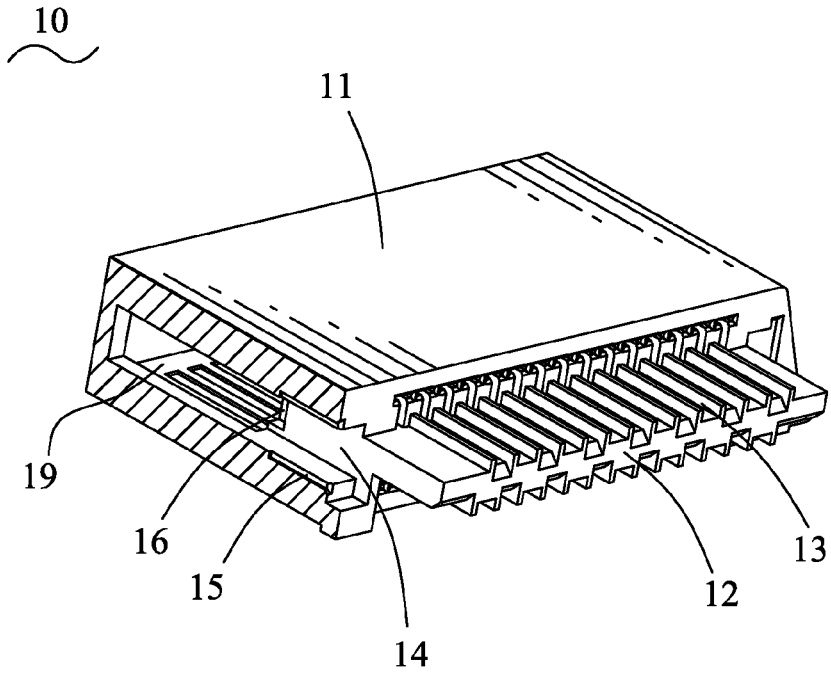
FIG. 3 is a sectional view of an insulating housing of the electrical connector of FIG. 2.

Referring to FIG. 2 and FIG. 3, the insulating housing 10 has a base body 11 of a trapezoid shape. The insulating housing 10 has a receiving chamber 19 penetrating through a rear surface thereof. A front wall 111, a top wall 112, a bottom wall 113 and two side walls 114 are formed around the receiving chamber 19. A middle of a front face of the front wall 111 of the base body 11 protrudes frontward to form a tongue portion 12. A top and a bottom of the tongue portion 12 defines a plurality of terminal passages 13 passing through an upper portion and a lower portion of the front wall 111 and extending longitudinally along inner insides of the top wall 112 and the bottom wall 113, respectively. The terminals 40 are received in the terminal passages 13. Two ends of the front wall 111 define two buckling grooves 15 each extending longitudinally to an inside of the corresponding side wall 114 and communicating with the receiving chamber 19. A rear of the buckling groove 15 is narrower than a front thereof. The two ends of the front wall 111 further defines two fixing grooves 14 each extending longitudinally to penetrate through the front wall 111 and adjacent to two opposite sides of the tongue portion 12 and connected with the receiving chamber 19 and a middle of an inside of the corresponding buckling groove 15. Middles of rears of inner sidewalls of the two fixing grooves 14 are concaved inward to form two fillisters 16, respectively.

Referring to FIG. 2, the two buckling parts 20 are made of metal plate. Each of the buckling parts 20 has an elongated base arm 21. A rear edge of the base arm 21 extends rearward and inclines sideward to form an elastic arm 22. A free end of the elastic arm 22 is arced inward to form a contact arm 23. A front edge of the base arm 21 extends forward to form a first fixing arm 24 having a greater width than that of the base arm 21. A front edge of the first fixing arm 24 extends forward to form a second fixing arm 25 having a greater width than that of the first fixing arm 24.

Figure 4:
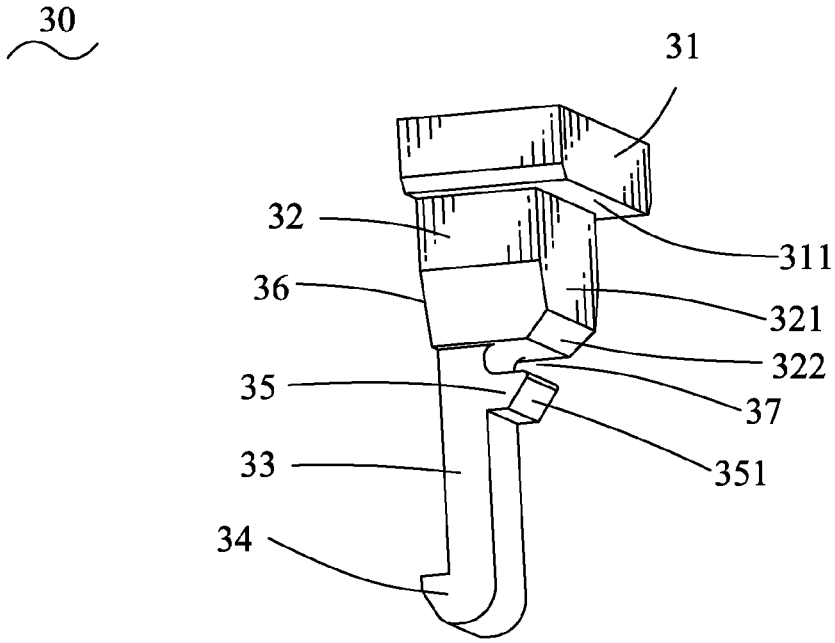
FIG. 4 is a perspective view of a locking element of the electrical connector of FIG. 2.
Figure 5:
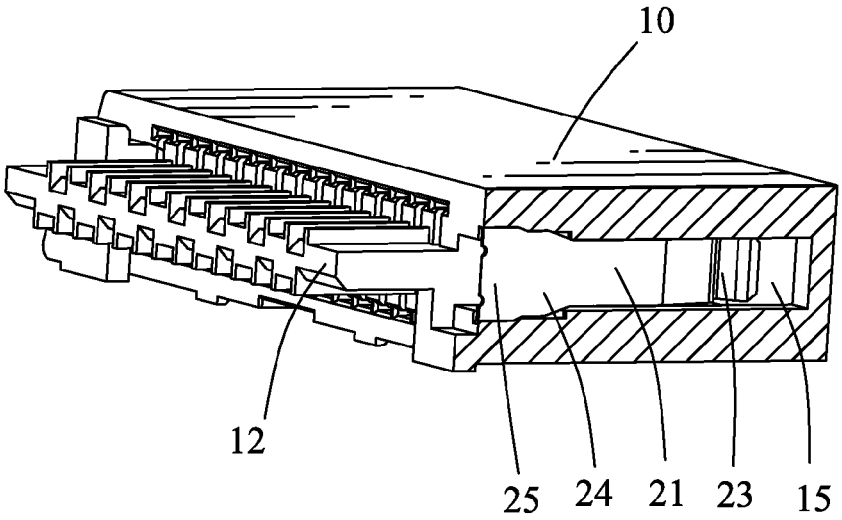
FIG. 5 is a partial sectional view of the insulating housing of FIG. 3 with a buckling part of FIG. 2 being assembled therein.
Figure 6:
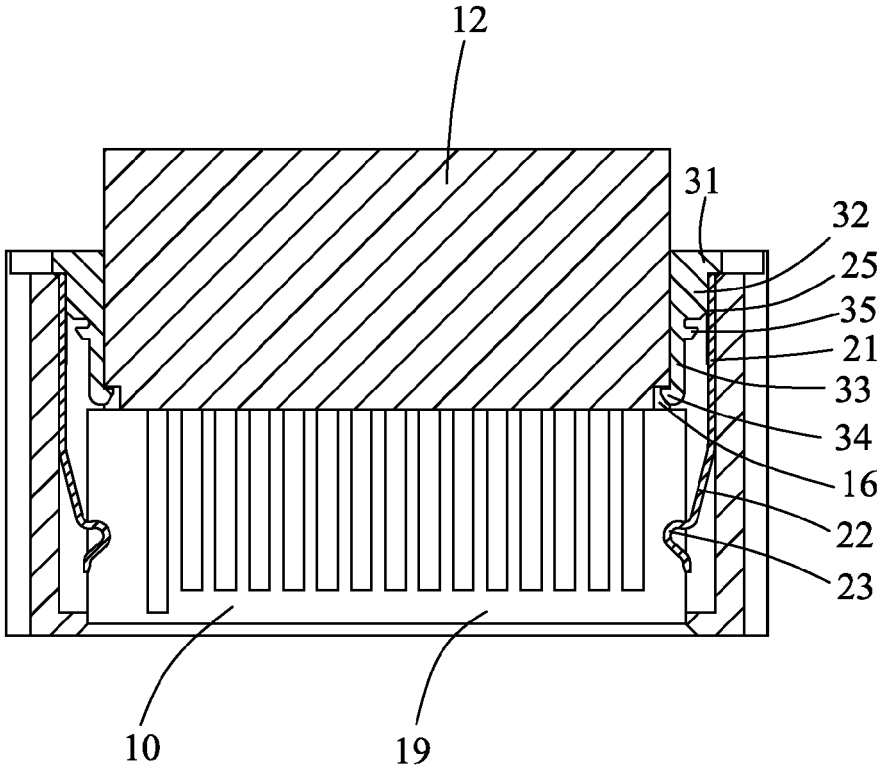
FIG. 6 is a sectional view of the insulating housing of FIG. 3 with the buckling parts and the locking elements of FIG. 2 being assembled therein.

Referring to FIG. 2 and FIG. 4, each locking element 30 has a rectangular base board 31. One of the largest surfaces is regarded as a contact surface 311. A fastening portion 32 is protruded rearward from a rear side of the contact surface 311 of the base board 31. A positioning portion 33 is protruded opposite to the base board 31 from a portion of a free end surface of the fastening portion 32. A side surface of the fastening portion 32 and a side surface of the positioning portion 33 are flush with a side surface of the base board 31, and the side surface of the fastening portion 32, the side surface of the positioning portion 33 and the side surface of the base board 31 together define an interaction surface 36. The other side surface of the fastening portion 32 opposite to the interaction surface 36 is regarded as a pressing surface 321. A joint of the pressing surface 321 and the free end surface of the fastening portion 32 is cut off along a longwise direction thereof to form a smooth incline 322 having a guiding function. A free end of the positioning portion 33 is extended opposite to the pressing surface 321 to form a hook 34. An upper portion of the other side surface of the positioning portion 33 opposite to the interaction surface 36 is protruded outward to form a protrusion 35 with a guiding surface 351 being formed at an outer surface thereof. An elastic groove 37 is formed between the free end surface of the fastening portion 32 and the protrusion 35. The elastic groove 37 provides a better plastic deformation for the locking element 30 during a process of assembling.

Referring to FIG. 1-FIG. 6, when the electrical connector 100 is assembled, the buckling parts 20 are inserted rearward in the buckling grooves 15 with the first and second fixing arms 24, 25 being buckled in the front of the buckling grooves 15 to prevent the buckling parts 20 sliding rearward to the receiving chamber 19. The contact arms 23 projects inward into the receiving chamber 19. Then, the locking elements 30 are inserted rearward in the fixing grooves 14 along the smooth incline 322. A front edge of the second fixing arm 25 further resists against the contact surface 311 of the locking element 30 to hold the buckling part 20 in the insulating housing 10. An inside of the second fixing arm 25 is against the pressing surface 321 and an outside of the second fixing arm 25 is against a sidewall of the buckling groove 15 to avoid the buckling parts 20 swaying. The hook 34 is fastened in the fillister 16 and the interaction surface 36 is against the inner sidewall of the fixing groove 14 for fastening the locking element 30 in the fixing groove 14 of the insulating housing 10 firmly. The protrusion 35 provides a protection function and the guiding surface 351 provides a guiding function for guiding the locking element 30 to be inserted in the fixing groove 14 so as to avoid the locking element 30 crashing the buckling part 20 to cause a movement of the buckling part 20. When the electrical connector 100 is engaged with or drawn out from a mated connector (not shown), the contact surfaces 311 are against the front edges of the second fixing arms 25 of the buckling parts 20 to prevent the buckling parts 20 being fallen off from the electrical connector 100.

As described above, the first and second fixing arms 24, 25 are buckled in the front of the buckling grooves 15 to prevent the buckling parts 20 sliding rearward to the receiving chamber 19, the free end of the second fixing arm 25 further resists against the contact surface 311 of the locking element 30 to prevent the buckling part 20 falling off from the buckling groove 15, the first and second fixing arms 24, 25 are located between the pressing surface 321 and the sidewalls of the buckling grooves 15 to avoid the buckling parts 20 swaying, so that the buckling parts 20 are fastened in the insulating housing 10 of the electrical connector 100 tightly.

What is claimed is:

1. An electrical connector, comprising:

an insulating housing having a receiving chamber penetrating through a rear surface thereof, a top wall, a bottom wall, a pair of side walls and a front wall being formed around the receiving chamber, two ends of the front wall defining two buckling grooves each extending longitudinally to an inside of the corresponding side wall and communicating with the receiving chamber, a rear of the buckling groove being narrower than a front thereof, the two ends of the front wall further defining two fixing grooves each extending longitudinally to penetrate through the front wall and connected with the receiving chamber and an inside of the corresponding buckling groove;

a plurality of terminals disposed in the insulating housing;

a buckling part inserted rearward in the buckling groove, the buckling part having a base arm, a contact arm projecting inward into the receiving chamber, and a fixing arm extending forward from a front edge of the base arm and having a greater width than that of the base arm to be buckled in the front of the buckling groove; and a locking element inserted rearward in the fixing groove, the locking element having a base board, a fastening portion protruded rearward from a rear side of the base board, and a hook protruded inward to grapple a rear of an inside of the fixing groove for fastening the locking element in the fixing groove, two opposite side surfaces of the fastening portion respectively abutting against the inside of the fixing groove and the fixing arm, and the rear side of the base board further resisting against a front edge of the fixing arm to hold the buckling part in the insulating housing.

2. The electrical connector as claimed in claim 1, wherein the fixing arm has a first fixing arm and a second fixing arm, the first fixing arm is connected between the base arm and the second fixing arm, and has a greater width than that of the base arm and a less width than that of the second fixing arm.

3. The electrical connector as claimed in claim 1, wherein a rear edge of the base arm of the buckling part extends rearward and inclined inward to form an elastic arm, the contact arm is formed by a rear end of the elastic arm arched inward.

4. The electrical connector as claimed in claim 1, wherein a joint of the side surface of the fastening portion presses against the fixing arm of the buckling part and a free end surface of the fastening portion is cut off to form an incline that guides the locking element to be inserted in the fixing groove.

5. The electrical connector as claimed in claim 1, wherein a free end surface of the fastening portion further protrudes rearward to form a positioning portion apart from the base arm of the buckling part, a side surface of the positioning portion opposite to the base arm of the buckling part abuts against the inside of the fixing groove, the hook is formed by a free end of the positioning portion protruding oppositely to the base arm of the buckling part.

6. The electrical connector as claimed in claim 5, wherein the rear of the inside of the fixing groove is concaved inward to form a fillister, the hook is buckled in the fillister.

7. The electrical connector as claimed in claim 5, wherein a front end of another side surface of the positioning portion facing the buckling part protrudes towards the base arm to form a protrusion apart from the fastening portion to define an elastic groove between the fastening portion and the protrusion.

8. The electrical connector as claimed in claim 7, wherein a face of the protrusion facing the base arm of the buckling part is designed as a guiding surface inclined towards the base arm from rear to front for guiding the locking element to be inserted in the fixing groove.

9. The electrical connector as claimed in claim 1, wherein a front face of the front wall of the insulating housing protrudes forward to form a tongue portion located between the two fixing grooves to prop up the terminals.

* * * * *